US007384314B1

(12) United States Patent
Xu

(10) Patent No.: US 7,384,314 B1
(45) Date of Patent: Jun. 10, 2008

(54) CONNECTOR FOR EIGHT DIFFERENT MEMORY CARDS

(75) Inventor: Yingzan Xu, Dongguan (CN)

(73) Assignee: Just Make Electronics Co., Ltd., Guangdong (CN)

( * ) Notice: Subject to any disclaimer, the term of this patent is extended or adjusted under 35 U.S.C. 154(b) by 0 days.

(21) Appl. No.: 11/774,580

(22) Filed: Jul. 7, 2007

(30) Foreign Application Priority Data

Mar. 8, 2007 (CN) ..... 2007 2 0118854 U

(51) Int. Cl.
*H01R 24/00* (2006.01)

(52) U.S. Cl. ..... 439/630; 439/541.5

(58) Field of Classification Search ..... 439/541.5, 439/630, 631; 235/492
See application file for complete search history.

(56) References Cited

U.S. PATENT DOCUMENTS 6,607,405 B2 * 8/2003 Nishimura ..... 439/630
6,672,904 B1 * 1/2004 Chen ..... 439/631
6,835,100 B1 * 12/2004 Chen ..... 439/630
6,902,435 B1 * 6/2005 Cheng ..... 439/630
7,234,969 B2 * 6/2007 Chang et al. ..... 439/630

FOREIGN PATENT DOCUMENTS

CN 200420007132.9 4/2005

* cited by examiner

*Primary Examiner*—Thanh-Tam Le
(74) *Attorney, Agent, or Firm*—Workman Nydegger

(57) ABSTRACT

A connector for eight memory cards, including an insulating body covered by a casing. A first receiving space for receiving memory cards is formed between the casing and the top surface of the insulating body. A second receiving space and a third receiving space for receiving memory cards are provided in the insulating body and below the first receiving space. A first inserting port is provided at a side of the first receiving space coupled to a front end of the insulating body. A second inserting port is provided at a side of the second receiving space coupled to the front end of the insulating body. A third inserting port is provided at a side of the third receiving space coupled to the front end of the insulating body.

11 Claims, 6 Drawing Sheets

CONNECTOR FOR EIGHT DIFFERENT MEMORY CARDS

TECHNICAL FIELD

The present invention relates to a connector, in particular to a connector for eight memory cards which may respectively have different standards.

BACKGROUND ART

The era of the flash memory comes since the NOR flash memory was invented in 1988. Since the flash memory has advantages such as high read-write property, long duration and more convenience in use, the flash memory is widely utilized in electronic devices for matching the main circuit of electronic devices with flash memory card which has different standards and serves as information storage medium. Among various flash memory cards, a SD card, a MMC card and a memory rod as three standard products play main role and have the minimized size in micro-type. For the millimeter scale of these three products, the SD card is 15 mm×11 mm×1 mm, the MMC card is 14 mm×12 mm×1.1 mm, the memory rod is 15 mm×12.5 mm×1.2 mm. Although the three products have similar sizes, the number of the contact tabs for micro SD card, the micro MMC card and the micro memory rod respectively are eight, ten, and eleven due to different standards for these three products.

The Chinese patent CN200420007132.9 discloses an improved terminal structure, in which a main body is provided outwards with a slot opening at one end thereof for inserting a memory card, and is provided with terminal ports or terminal seats at the other end thereof for respectively connecting a first terminal of the SMC card, a second terminal of the MS card and a third terminal of the SD card. The body portion of each terminal is provided backwards with a support leg, a tailing end of each support leg is bent to form a welding segment, each support leg of the first terminal, the second terminal and the third terminal is deviated towards one side (the left side or the right side) of the body portion of the respective terminal and bent so that these support legs are not be contacted with each other, and thus the welding segments of the three terminals are aligned with each other.

In the above prior art, although more than two different cards can be applied into one electronic device, it can not be satisfied that much more different cards are compatible to one electronic device.

SUMMARY OF THE INVENTION

The present invention is directed to overcome the deficiencies in the prior art and provides a connector for eight memory cards, wherein the connector comprises: a casing; an insulating body which is covered by the casing at a top surface thereof, wherein a first receiving space for receiving memory cards is formed between the casing and the top surface of the insulating body, a second receiving space and a third receiving space for receiving memory cards are provided in the insulating body and below the first receiving space, a first inserting port is provided at a side of the first receiving space coupled to a front end of the insulating body, a second inserting port is provided at a side of the second receiving space coupled to the front end of the insulating body, and a third inserting port is provided at a side of the third receiving space coupled to the front end of the insulating body; a first set of conductive terminals, each of which comprises a first end disposed in the first receiving space and a second end extended out of a rear end of the insulating body; a second set of conductive terminals, each of which comprises a first end disposed in the first receiving space in a position closer to the front end of the insulating body than the first set of conductive terminals and a second end extended out of the rear end of the insulating body; a third set of conductive terminals, each of which comprises a first end disposed in the second receiving space and a second end extended out of the front end of the insulating body; a fourth set of conductive terminals, each of which comprises a first end disposed in the third receiving space and a second end extended out of the front end of the insulating body; a fifth set of conductive terminals in U-shape, a bent end of each U-shape conductive terminal is interposed between the conductive terminals of the first set at interval, a non-bent end of each U-shape conductive terminal is extended out of the front end of the insulating body; a first set of holding arms which are disposed between the third set of conductive terminals and the casing and one of which is contacted with the casing; a second set of holding arms which are disposed at a side of the first set of conductive terminals; a first connecting arm which is disposed at the other side of the first set of conductive terminals; and a second connecting arm which is disposed at a side of the second set of conductive terminals and contacted with the casing, and which is contacted with the first connecting arm when assembled in the insulating body.

Preferably, the second receiving space and the third receiving space have an overlapping part therebetween.

Preferably, each holding arm of the second set of holding arms comprises a base part, an end of which is extended to form a fixed portion, and the other end of which is extended and bent to form an elastic portion.

Preferably, the elastic portion is a curved protrusion bent towards the first set of conductive terminals.

Preferably, the first connecting arm comprises a base part, an end of which is extended to form a fixed portion, and the other end of which is extended and bent to form an elastic portion.

Preferably, the elastic portion is a curved protrusion bent towards the first set of conductive terminals.

Preferably, the connector further comprises a holding piece holding on the front end of the insulating body and having three elastic pieces extended therefrom.

Preferably, the holding piece is of a substantial rectangular-sheet structure as a whole.

Preferably, the three elastic pieces comprises a first elastic piece disposed at a side of the holding piece, a second elastic piece and a third elastic piece which are disposed at the other side of the elastic holding piece and spaced apart from each other at a certain distance.

Preferably, each holding arm of the first set of holding arms comprises a base part, an end of which is extended and bent to form an elastic portion.

Preferably, the first set of conductive terminals comprise eleven terminals, the second set of conductive terminals comprise nine terminals, the third set of conductive terminals comprise eight terminals, the fourth set of conductive terminals comprise ten terminals, and the fifth set of conductive terminals comprise four terminals.

In comparison with the prior art, micro-type memory cards of eight different standards may be inserted into the connector for eight memory cards according to the present invention for the use in the electronic devices, and the connector for eight memory cards have fool-proof function.

DETAILED DESCRIPTION OF THE PREFERRED EMBODIMENTS

Figure 1:
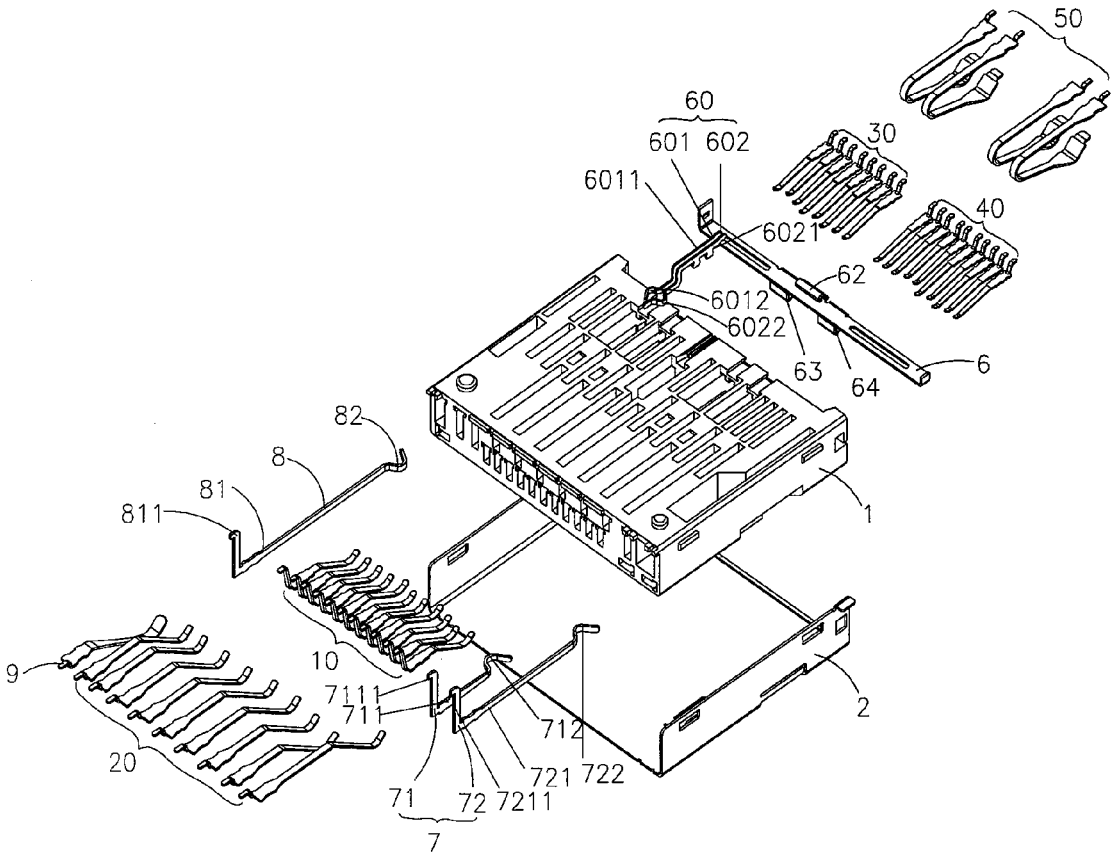
FIG. 1 is a perspective exploded view of the connector for eight memory card of the present invention shown in an angle of view.
Figure 2:
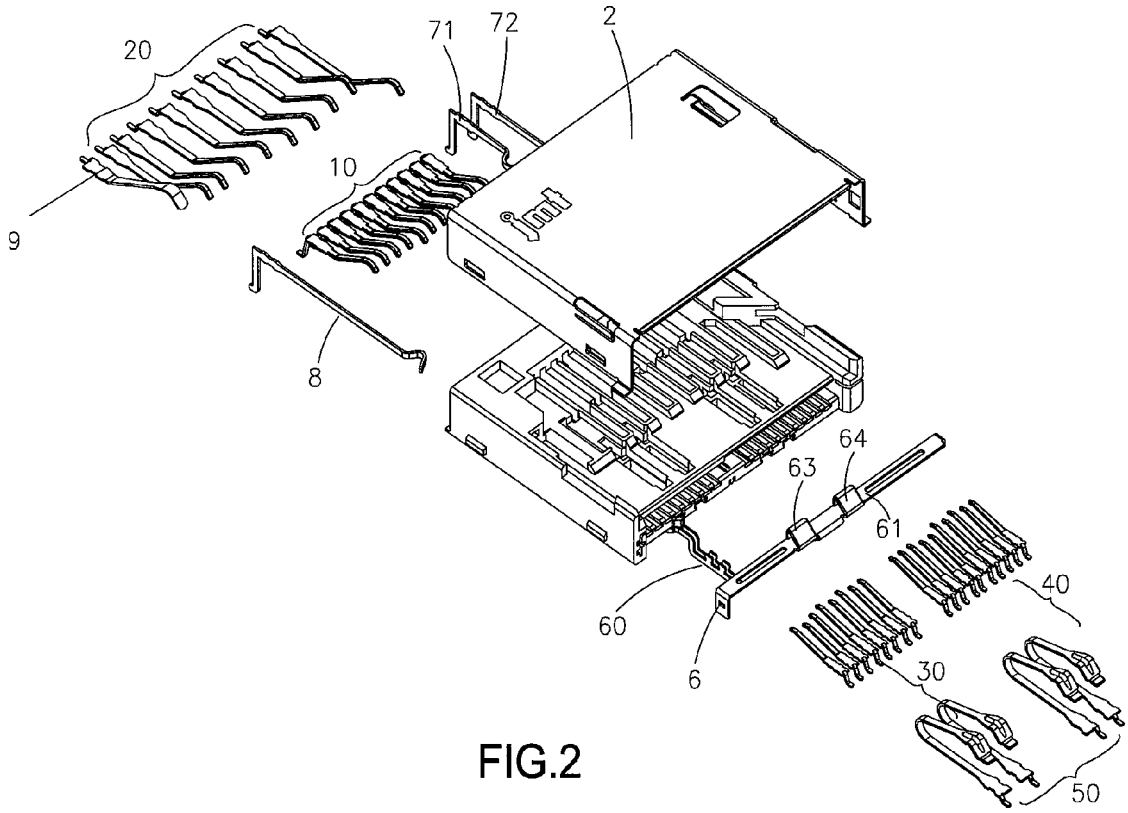
FIG. 2 is a perspective exploded view of the connector for eight memory card of the present invention shown in another angle of view.

The present invention will be described in details with reference to the drawings.

As shown in FIGS. 1-4, the present invention provides a connector for eight memory cards, wherein the connector comprises an insulating body 1, a casing 2 made of conducting material such as metal, nonmetal or composite material, a first set of conductive terminals 10, a second set of conductive terminals 20, a third set of conductive terminals 30, a fourth conductive set of terminals 40, a fifth set of conductive terminals 50, an holding piece 6, a first set of holding arms 60, a second set of holding arms 7, a first connecting arm 8 and a second connecting arm 9.

The insulating body 1 is covered by the casing 2 at the top surface thereof, a first receiving space for receiving the memory cards is formed between the casing 2 and the top surface of the insulating body 1, a second receiving space and a third receiving space for receiving memory cards are provided in the insulating body and below the first receiving space, a first inserting port 3 is provided at a side of the first receiving space coupled to a front end of the insulating body 1, a second inserting port 4 is provided at a side of the second receiving space coupled to the front end of the insulating body 2, and a third inserting port 5 is provided at a side of the third receiving space coupled to the front end of the insulating body 2. That is to say, the three inserting ports are located at one side of the insulating body 1. It is preferable that the second receiving space and the third receiving space have an overlapping part therebetween.

The first set of conductive terminals 10 comprises eleven terminals, and each terminal comprises a first end disposed in the first receiving space and a second end extended out of a rear end of the insulating body 1.

The second set of conductive terminals 20 comprises nine terminals, and each terminal comprises a first end disposed in the first receiving space in a position closer to the front end of the insulating body 1 than the first set of conductive terminals 10 and a second end extended out of the rear end of the insulating body 1.

The third set of conductive terminals 30 comprises eight terminals, and each terminal comprises a first end disposed in the second receiving space and a second end extended out of the front end of the insulating body 1.

The fourth set of conductive terminals 40 comprises ten terminals, and each terminal comprises a first end disposed in the third receiving space and a second end extended out of the front end of the insulating body 1.

The fifth set of conductive terminals 50 comprises four U-shape terminals and a bent end of each U-shape terminal is interposed between the first set of conductive terminals 10 at interval, a non-bent end of each U-shape terminal is extended out of the front end of the insulating body.

A holding piece 6 is held on the front end of the insulating body 1 and is of a substantial rectangular-sheet structure as a whole. The holding piece 6 has three elastic pieces extended therefrom, and the three elastic pieces respectively are a first elastic piece 62 disposed at a side of the holding piece 6, a second elastic piece 63 and a third elastic piece 64 which are disposed at the other side of the holding piece 6 and spaced apart from each other at a certain distance.

The first set of holding arms 60 is disposed between the third set of conductive terminals 30 and the casing 2, and comprises two holding arms 601 and 602 wherein the holding arm 601 is contacted with the casing 2. The holding arm 601 comprises a base part 6011, from which two protrusions for installation are extended. An end of the base part 6011 is extended and bent to form an elastic portion 6012 which is a curved protrusion. The holding arm 602 comprises a base part 6021, from which two protrusions for installation are extended. An end of the base part 6021 is extended and bent to form an elastic portion 6022 which is a curved protrusion. The curved protrusions are formed such that the top ends thereof are departed from each other.

The second set of holding arms 7 is disposed at a side of the first set of conductive terminals 10 and comprises a holding arm 71 and a holding arm 72 which is shorter than the holding arm 71. The holding arm 71 comprises a base part 711, an end of the base part 711 is extended to form a fixed portion 7111 and the other end of the base part 711 is extended and bent to form an elastic portion 712 which is a curved protrusion bent towards the first set of conductive terminals 10. The holding arm 72 comprises a base part 721, an end of the base part 721 is extended to form a fixed portion 7211 and the other end of the base part 721 is extended and bent to form an elastic portion 722 which is a curved protrusion bent towards the first set of conductive terminals 10.

The first connecting arm 8 is disposed at the other side of the first set of conductive terminals 10 and comprises a base part 81. An end of the base part 81 is extended to form a fixed portion 811, and the other end of the base part 81 is extended and bent to form an elastic portion 82 which is a curved protrusion bent towards the first set of conductive terminals 10.

The second connecting arm 9 is disposed at a side of the second set of conductive terminals 20 and contacted with the casing 2. The second connecting arm 9 will be contacted with the first connecting arm 8 when assembled in the insulating body 1. That is to say, the first connecting arm 8 and the second connecting arm 9 are disposed at the same side with respect to the insulating body 1.

Figure 3:
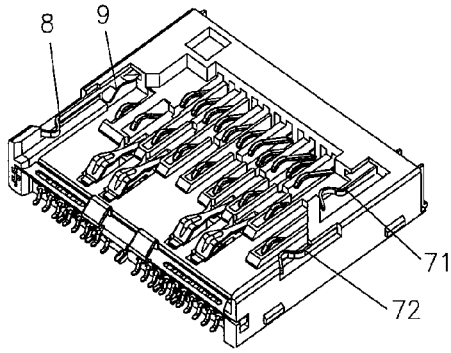
FIG. 3 is a perspective view of the connector for eight memory card of the present invention in which a casing is removed.
Figure 4:
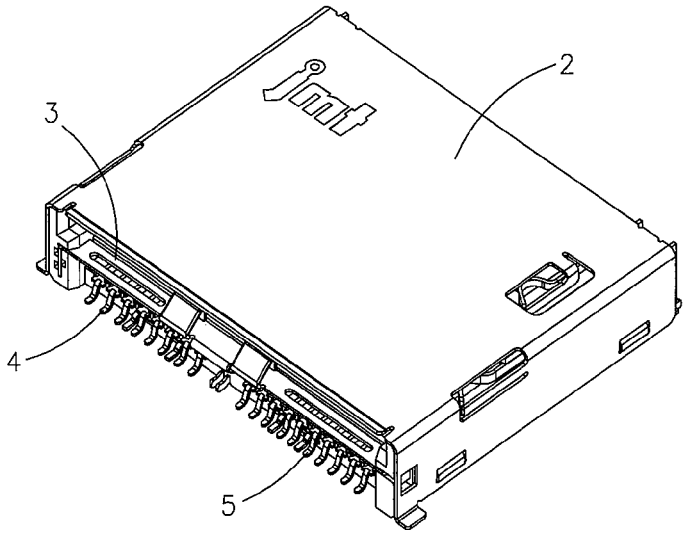
FIG. 4 is a perspective view of the connector for eight memory card of the present invention in an assembled state shown in an angle of view.
Figure 5:
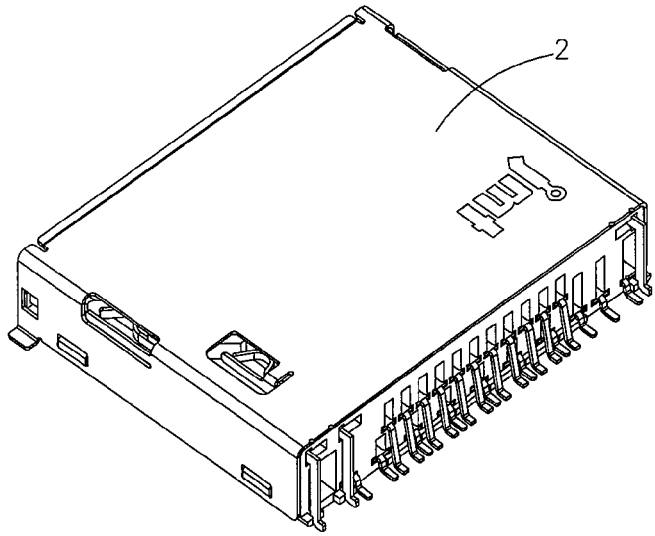
FIG. 5 is a perspective view of the connector for eight memory card of the present invention in an assembled state shown in another angle of view.
Figure 6A:
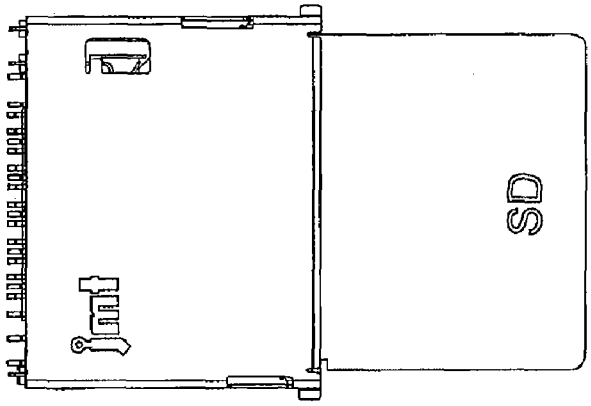
FIG. 6A is a top view of the connector for eight memory card of the present invention into which a SD card is inserted.
Figure 6B:
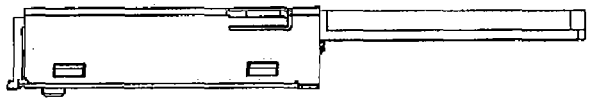
FIG. 6B is a side view of the connector with the SD card shown in FIG. 6A.
Figure 7A:
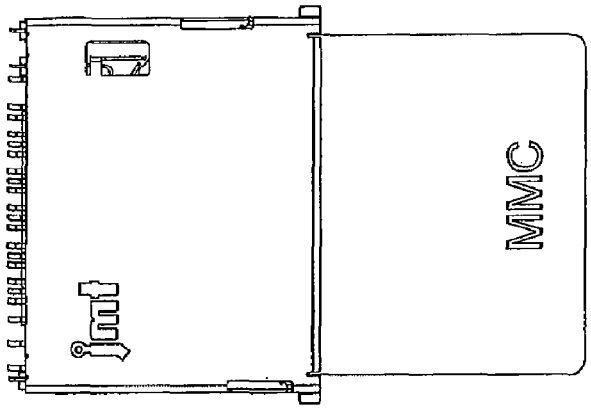
FIG. 7A is a top view of the connector for eight memory card of the present invention into which a MMC card or a MMC4.0 card is inserted.
Figure 7B:
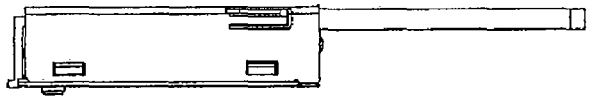
FIG. 7B is a side view of the connector with the MMC card or the MMC4.0 card shown in FIG. 7A.
Figure 8A:
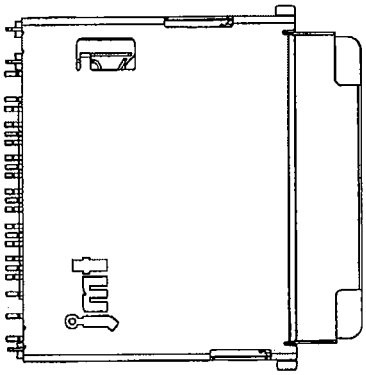
FIG. 8A is a top view of the connector for eight memory card of the present invention into which a RSMMC card or a RSMMC4.0 card is inserted.
Figure 9A:
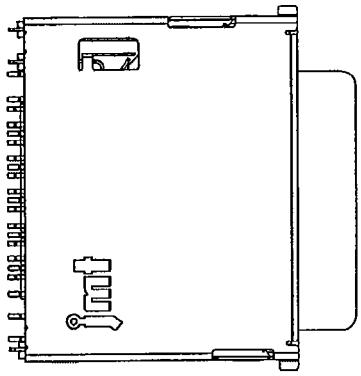
FIG. 9A is a top view of the connector for eight memory card of the present invention into which a Mini SD card is inserted.
Figure 8B:
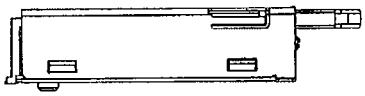
FIG. 8B is a side view of the connector with the RSMMC card or the RSMMC4.0 card shown in FIG. 8A.
Figure 9B:
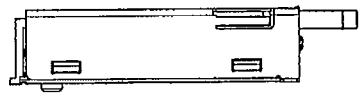
FIG. 9B is a side view of the connector with the Mini SD card shown in FIG. 9B.

As shown in FIG. 3, after all of the first set of conductive terminals 10, the second set of conductive terminals 20, the third set of conductive terminals 30, the fourth set of conductive terminals 40 and the fifth set of conductive terminals 50 are inserted into respective receiving spaces, the holding piece 6 is installed onto the insulating body 1. The holding arm 601 and the holding arm 602 of the first set of holding arms 60 are respectively inserted into the second receiving space and the third receiving space, and the basis part 6011 and the basis part 6012 are coupled to the holding piece 6. The first elastic piece 62, the second elastic piece 63 and the third elastic piece 64 are located on the first inserting port 3, the second inserting port 4 and the third inserting port 5, respectively. As shown in FIGS. 4 and 5, after further assembling the casing 2, the second connecting arm 9 will be contacted with the casing 2 so as to form an electrically connecting circuit.

When a memory card is inserted into a respective receiving space, the memory card will be contacted with respective elastic portions 6011, 6021, 712, 722 and 82 of the first set of holding arms 60, the second set of holding arms 7 and the first connecting arm 8 in protrusion shape, so that the respective elastic portions in protrusion shape will be pressed towards the both side of the memory card and thus to contact with the casing 2.

Figure 10A:
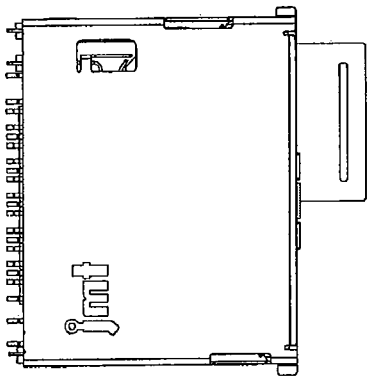
FIG. 10A is a top view of the connector for eight memory card of the present invention into which a Micro MMC card is inserted.
Figure 11A:
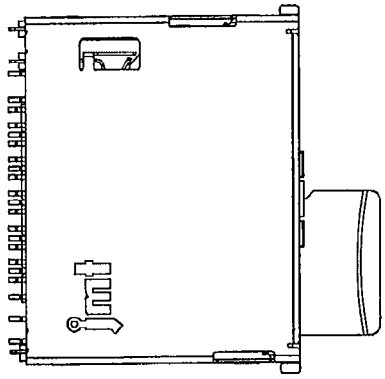
FIG. 11A is a top view of the connector for eight memory card of the present invention into which a Micro SD card is inserted.
Figure 10B:
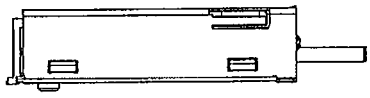
FIG. 10B is a side view of the connector with the Mircro MMC card shown in FIG. 10A.
Figure 11B:
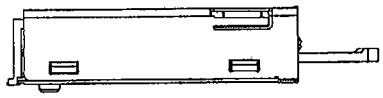
FIG. 11B is a side sectional view of the connector with Micro SD card shown in FIG. 11A.

When the connector of the present invention is used, one of SD card, MMC card, MMC4.0 card, RSMMC card, RSMMC4.0 card and Mini card may be selectively inserted into the first receiving space, as shown in FIGS. 6*a*-9*b*; Micro MMC card may be inserted into the second receiving space, as shown in FIGS. 10*a* and 10*b*; Micro SD card may be inserted into the third receiving space, as shown in FIGS. 11*a* and 11*b*. As can be seen from the above, the connector of the present invention can be selectively inserted with eight different memory cards.

Figure 12A:
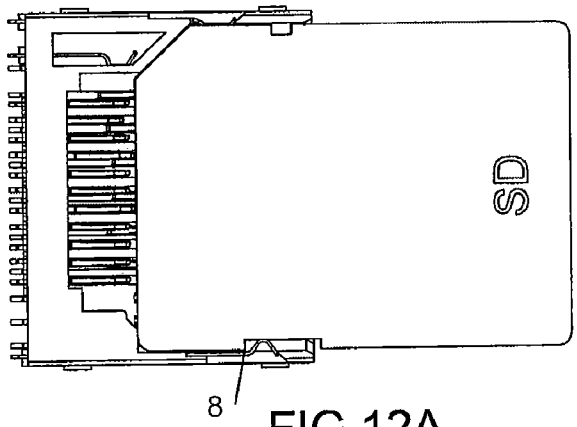
FIG. 12A is a top view of the connector for eight memory card of the present invention into which a Micro SD card is inserted and in which the casing is not assembled.
Figure 12B:
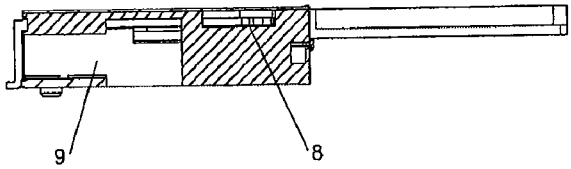
FIG. 12B is a side sectional view of the connector with Micro SD card shown in FIG. 12A.

As shown in FIGS. 12*a* and 12*b*, when one of SD card, MMC card, MMC4.0 card, RSMMC card, RSMMC4.0 card is selectively inserted into the first receiving space, the first connecting arm 8 and the holding arm 72 of the second set of holding arms 7 are respectively contacted with the casing 2 so as to form a electrically conducted connection. When a Mini SD card is inserted into the first receiving space, the first connecting arm 8 is not connected with the casing 2, but is connected with the second connecting arm 9, and the holding arm 72 of the second set of holding arms 7 is not contacted with the casing 2, but the holding arm 71 of the second set of holding arms 7 is connected with the casing 2.

Figure 13A:
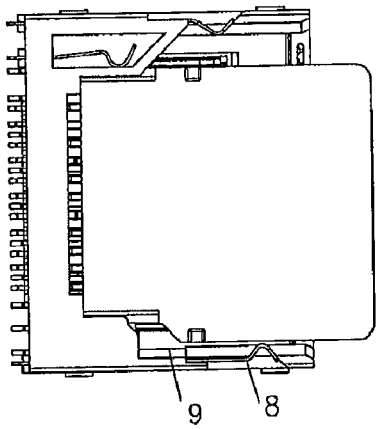
FIG. 13A is a top view of the connector for eight memory card of the present invention into which a Mini SD card is inserted and in which the casing is not assembled.
Figure 13B:
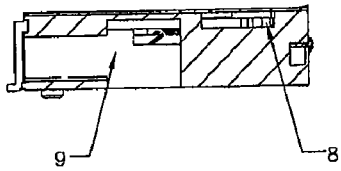
FIG. 13B is a side sectional view of the connector with Mini SD card shown in FIG. 13A.

As shown in FIGS. 13*a* and 13*b*, when one of MMC card, RSMMC card, and SD card is selectively inserted into the first receiving space, nine terminals of the second set of conductive terminals 20 are respectively corresponding to nine golden fingers of the inserted card; when one of MMC4.0 card and RSMMC4.0 card is selectively inserted into the first receiving space, nine terminals of the second set of conductive terminals 20 and four terminals of the fifth set of conductive terminals 50 are respectively corresponding to thirteen golden fingers of the inserted card.

In the use of the connector of the present invention, the connector will be connected with the external components. Since the casing 2 will be connected to the grounding conducting line, and the connecting arm 9 and the holding arm 601 is contacted with casing 2, a grounding circuit will be formed for the inserted card when one of the above cards is selectively inserted into the corresponding receiving space.

Since the second receiving space and the third receiving space have an overlapping part therebetween, only one card may be inserted into the second receiving space or the third receiving space. That is to say, two cards can not be respectively inserted into the second receiving space and the third receiving space at the same time. When one card is inserted into the second receiving space or the third receiving space, the one card will abut against the second elastic piece 63 or the third elastic piece 64 on the holding piece 6. Due to the elastic property of the holding piece 6, the holding piece 6 as a whole will be bent upwards and thus may block the first inserting port 3, so that another card can not be inserted into the first receiving space from the first inserting port 3. Similarly, when a card is inserted into the first receiving space, the holding piece 6 will be bent downward and thus may block the second inserting port 4 and the third inserting port 5, so that another card can not be inserted into the second receiving space from the second inserting port 4 or into the third receiving space from the third inserting port 5. In this way, only one card can be inserted into the connector of the present invention, and the connector of the present invention is compatible to eight different cards.

The above embodiment is only preferable example of the connector of the present invention, and may not used to limit the present invention. The person skilled in the art may perform different modifications, variations and replacements within the main technical concept of the present invention without the scope of the present invention defined in the appended claims.

What is claimed is:

1. A connector for eight memory cards, wherein the connector comprises:

a casing;

an insulating body which is covered by the casing at a top surface thereof, wherein a first receiving space for receiving memory cards is formed between the casing and the top surface of the insulating body, a second receiving space and a third receiving space for receiving memory cards are provided in the insulating body and below the first receiving space, a first inserting port is provided at a side of the first receiving space coupled to a front end of the insulating body, a second inserting port is provided at a side of the second receiving space coupled to the front end of the insulating body, and a third inserting port is provided at a side of the third receiving space coupled to the front end of the insulating body;

a first set of conductive terminals, each of which comprises a first end disposed in the first receiving space and a second end extended out of a rear end of the insulating body;

a second set of conductive terminals, each of which comprises a first end disposed in the first receiving space in a position closer to the front end of the insulating body than the first set of conductive terminals and a second end extended out of the rear end of the insulating body;

a third set of conductive terminals, each of which comprises a first end disposed in the second receiving space and a second end extended out of the front end of the insulating body;

a fourth set of conductive terminals, each of which comprises a first end disposed in the third receiving space and a second end extended out of the front end of the insulating body;

a fifth set of conductive terminals in U-shape, a bent end of each U-shape conductive terminal is interposed between the conductive terminals of the first set at interval, a non-bent end of each U-shape conductive terminal is extended out of the front end of the insulating body;

a first set of holding arms which are disposed between the third set of conductive terminals and the casing and one of which is contacted with the casing;

a second set of holding arms which are disposed at a side of the first set of conductive terminals;

a first connecting arm which is disposed at the other side of the first set of conductive terminals; and a second connecting arm which is disposed at a side of the second set of conductive terminals and contacted with the casing, and which is contacted with the first connecting arm when assembled in the insulating body.

2. The connector for eight memory cards according to claim 1, wherein the second receiving space and the third receiving space have an overlapping part therebetween.

3. The connector for eight memory cards according to claim 1, wherein each holding arm of the second set of holding arms comprises a base part, an end of which is extended to form a fixed portion, and the other end of which is extended and bent to form an elastic portion.

4. The connector for eight memory cards according to claim 3, wherein the elastic portion is a curved protrusion bent towards the first set of conductive terminals.

5. The connector for eight memory cards according to claim 1, wherein the first connecting arm comprises a base part, an end of which is extended to form a fixed portion, and the other end of which is extended and bent to form an elastic portion.

6. The connector for eight memory cards according to claim 5, wherein the elastic portion is a curved protrusion bent towards the first set of conductive terminals.

7. The connector for eight memory cards according to claim 1, the connector further comprises a holding piece holding on the front end of the insulating body and having three elastic pieces extended therefrom.

8. The connector for eight memory cards according to claim 7, wherein the holding piece is of a substantial rectangular-sheet structure as a whole.

9. The connector for eight memory cards according to claim 7, wherein the three elastic pieces comprises a first elastic piece disposed at a side of the holding piece, a second elastic piece and a third elastic piece which are disposed at the other side of the elastic holding piece and spaced apart from each other at a certain distance.

10. The connector for eight memory cards according to claim 1, wherein each holding arm of the first set of holding arms comprises a base part, an end of which is extended and bent to form an elastic portion.

11. The connector for eight memory cards according to claim 1, wherein the first set of conductive terminals comprise eleven terminals, the second set of conductive terminals comprise nine terminals, the third set of conductive terminals comprise eight terminals, the fourth set of conductive terminals comprise ten terminals, and the fifth set of conductive terminals comprise four terminals.

* * * * *